US007419139B2

(12) United States Patent
Pavlov

(10) Patent No.: US 7,419,139 B2
(45) Date of Patent: Sep. 2, 2008

(54) BARBED TAPE PRODUCT WITH A PREDETERMINED PATTERN OF ATTACHMENT POINTS AND ATTACHMENT ELEMENTS

(76) Inventor: Michael V. Pavlov, Route 32, P.O. Box 209, Bloomington, NY (US) 12411

( * ) Notice: Subject to any disclaimer, the term of this patent is extended or adjusted under 35 U.S.C. 154(b) by 172 days.

(21) Appl. No.: 10/959,531

(22) Filed: Oct. 5, 2004

(65) Prior Publication Data

US 2006/0022185 A1 Feb. 2, 2006

Related U.S. Application Data

(60) Provisional application No. 60/589,668, filed on Jul. 19, 2004.

(51) Int. Cl.
*E04H 17/04* (2006.01)

(52) U.S. Cl. ..... 256/2; 256/1; 256/6; 256/8

(58) Field of Classification Search ..... 256/1–9; D25/46

See application file for complete search history.

(56) References Cited

U.S. PATENT DOCUMENTS

| | | | | |
|---|---|---|---|---|
| 2,801,080 | A | 7/1957 | See | |
| 2,908,484 | A | 10/1959 | Uhl | |
| 2,910,256 | A * | 10/1959 | Leidolf | 245/1 |
| 3,070,946 | A | 1/1963 | Kirsch et al. | |
| 3,155,374 | A * | 11/1964 | Sieffert | 256/2 |
| 3,463,455 | A | 8/1969 | Meckel et al. | |
| 3,916,958 | A | 11/1975 | Uhl | |
| 4,367,059 | A | 1/1983 | Stubbins | |
| 4,484,729 | A * | 11/1984 | Mainiero et al. | 256/1 |
| 4,503,423 | A * | 3/1985 | Mainiero et al. | 340/552 |
| 4,509,726 | A | 4/1985 | Boggs et al. | |
| 4,666,129 | A | 5/1987 | Dobson | |
| 4,744,708 | A | 5/1988 | Cochrane | |
| 4,818,972 | A | 4/1989 | Mainiero et al. | |
| 4,906,975 | A | 3/1990 | Casella et al. | |
| 4,915,359 | A | 4/1990 | Cochrane | |
| 4,978,943 | A | 12/1990 | Mainiero et al. | |
| 5,074,529 | A | 12/1991 | Mainiero et al. | |

(Continued)

FOREIGN PATENT DOCUMENTS

| | | |
|---|---|---|
| DE | 1 215 029 | 4/1966 |

*Primary Examiner*—Daniel P. Stodola
*Assistant Examiner*—Nahid Amiri
(74) *Attorney, Agent, or Firm*—Schmeiser, Olsen & Watts LLP

(57) ABSTRACT

A barbed tape product as adjacent pairs of loops in which the loops of a pair are attached to each other at an attachment point that is circumferentially offset relative to an attachment point of the adjacent pair of loops. Additional attachment points may be provided in helically progressive positions between the first and second attachment points. The attachment points are positioned on one pair of loops so that each of the attachment points are circumferentially offset relative to all other attachment points on an adjacent pair of loops. The attachment points may be positioned in a predetermined helically progressive pattern on a coil of the product. The pattern may provide a predetermined natural configuration of the product when the product is in a deployed state of use. Attachment elements for attaching strands of the product together are sized and configured for strength and accuracy in automatically attached concertina or other barbed tape products.

9 Claims, 12 Drawing Sheets

U.S. PATENT DOCUMENTS 5,109,583 A 5/1992 Pavlov
5,139,234 A 8/1992 Cochrane
5,401,002 A * 3/1995 Major ..... 256/2
D429,342 S * 8/2000 Binns ..... D25/46
6,457,282 B1 * 10/2002 O'Toole ..... 52/81.2
2003/0099523 A1 * 5/2003 Pessach et al. ..... 410/42

* cited by examiner

BARBED TAPE PRODUCT WITH A PREDETERMINED PATTERN OF ATTACHMENT POINTS AND ATTACHMENT ELEMENTS

This application claims the benefit of U.S. Provisional Patent Application Ser. No. 60/589,668, entitled RAPID DEPLOYMENT BARBED TAPE AND DISPENSER, by the same inventor, filed Jul. 19, 2004, the disclosure of which is incorporated herein by reference.

BACKGROUND OF THE INVENTION

1. Technical Field

This invention generally relates to a barbed tape product, and more particularly to a barbed tape product having a predetermined pattern of attachment points.

2. State of the Art

Barbed tape products are known. Much of the process of making such products has been automated. For example, forming the barbs from a stock tape material has been automated. Also, placement of a reinforcing wire within a channel formed in the tape has been automated. Bending of the barbed tape product into round coils is also part of known production processes. However, automatically and efficiently clipping adjacent strands of barbed tape product together has been virtually unsuccessful. Accordingly, most manufacturers rely upon manually attaching adjacent strands of the product in a concertina or other pattern. Most concertina products have three attachment elements for every two winds (or loops) of the product strand. These elements are generally placed at equally spaced circumferential positions along the product strand. Known barbed tape concertina products seldom purposely depart from this pattern except for between rolls when attaching is suspended, the strand is severed, and the machine is re-threaded for a subsequent roll of product.

Attachment elements such as generally U-shaped clips with arms that extend from a base and surround a pair of strands are known. In these clips, the arms interleave with each other in an attached configuration. These clips are attached with a clip gun that is typically actuated by a human operator. For convenience, multiple clips are held together in a string by a pair of filaments. The string of clips is fed into the clip gun so that the clip gun may be actuated repeatedly.

DISCLOSURE OF THE INVENTION

The present invention relates to a barbed tape product having a predetermined pattern of attachment points and attachment elements. The predetermined pattern of attachment points is programmed into an electronic controller of a system for automatically producing a concertina or other barbed tape product. This system may include the automation applied on past devices. However, the system also advantageously provides automated positioning of attachment points and automated attachment by attachment elements. The system provides a high degree of accuracy wherein the attachment points and the attachment elements may be placed in the predetermined pattern with few if any misplaced attachments. This system and associated methods are the subject of a U. S. patent application Ser. No. 10/959,944. by the same Applicant as this Application, entitled "SYSTEM AND METHODS FOR FORMING BARBED TAPE PRODUCT", filed Oct. 5, 2004, the disclosure of which is incorporated herein by reference.

While barbed tape products of the past have generally been limited to the standard repeating patterns described above, the present invention is not limited in the same way. Rather, any pattern may be programmed into the electronic controller and the product may be made accordingly. One aspect of the invention that is believed to be advantageous in reducing misplaced attachments involves circumferentially offsetting attachment points on one cycle of the product relative to an adjacent cycle. For concertina products, this translates into offsetting the attachment points of one pair of loops of the product relative to the attachment points on an adjacent pair of loops. This, together with other aspects of the invention, has enabled automatic clipping by a clipping gun integrated into the system with few if any misclips. Another aspect that facilitates automation of the clipping process involves providing modified attachment elements or clips. Certain standard clips are available on the market. These clips are configured to be used with pairs of strands of a particular size. However, these clips require a great deal of accuracy in placement of the clipping gun relative to the strands in order to avoid misclipping. Hence, clips that cover larger areas than the standard clips available on the market have been developed. These clips are manufactured with certain strengthening processes that have been implemented in the production of the clips of the present invention. Hence, providing the strengthening and increasing the area covered by the clips provide advantages that were not previously enjoyed in the industry. The resulting products will be described in simple terms in the paragraphs that follow.

In one aspect, the invention may include a strand of the product in the form of a continuous helical coil. The strand of product may include at least a first pair of loops and a second pair of loops. A first attachment element may hold the first pair of loops together. A second attachment element may hold the second pair of loops together. The first attachment element may be circumferentially offset relative to the second attachment element.

The first and second pairs of loops may be adjacent pairs of loops. At least one additional attachment element may be provided on the strand in a helically progressive position between the first attachment element and the second attachment element. The at least one additional attachment element may hold the first and second pairs of loops together. In particular, a plurality of additional attachment elements may be provided on the strand in helically progressive positions between the first and second attachment elements.

The strand of the product may further include additional pairs of loops and additional attachment elements holding the loops of each pair together and holding the pairs of loops together. The attachment elements may be generally positioned on one pair of loops so that each attachment element is circumferentially offset relative to all other attachment elements on an adjacent pair of loops.

In another aspect, a barbed tape product may include a strand of the product in the form of a continuous helical coil with a first attachment configuration including at least a first attachment point on the strand. A second attachment configuration may including at least a second attachment point on the strand. The first and second configurations may correspond to respective first and second lengths of the strand that each extend through an arc of approximately 360 degrees or more. The first attachment point may be circumferentially offset relative to all second attachment points in the second length, including the second attachment point.

The barbed tape product may have a first fastener or attachment at the first attachment point and a second fastener or attachment at the second attachment point. The first and second fasteners or attachments attach the first length to the second length of the strand and the first and second lengths form adjacent first and second loops of the strand corresponding to respective first and second adjacent cycles.

The first attachment configuration may include a plurality of first attachment points including the first attachment point. The second attachment configuration may include a plurality of second attachment points including the second attachment point. Each of the plurality of first attachment points may be circumferentially offset relative to each of the plurality of second attachment points. The barbed tape product may include a plurality of first fasteners or attachments at the plurality of first attachment points and a plurality of second fasteners or attachments at the plurality of second attachment points. For a concertina product, the plurality of first attachments and the plurality of second attachments attach first and second pairs of loops comprising adjacent lengths of the strand together. The first and second pairs of loops correspond to respective first and second adjacent cycles and have a helically progressive pattern of attachment points forming a barbed tape concertina product. For a non-concertina product, the plurality of first attachments and the plurality of second attachments may attach first and second adjacent lengths comprising adjacent first and second loops of the strand together. In this case, the first and second lengths may correspond to respective first and second adjacent cycles in a helically progressive pattern forming a non-concertina barbed tape product.

The attachment elements may be positioned in a predetermined pattern on the strand forming the continuous coil. The pattern may be a repeating pattern and provide a predetermined natural configuration of the product when the product is stretched out in a deployed state of use. For example, the pattern may provide a donut or a ball configuration when the product is stretched out in a deployed state of use.

In another aspect, the invention may include one or more attachment elements for holding two adjacent strands of barbed tape concertina product together. The attachment element may include a generally U-shaped staple structure having a central base and a plurality of arms extending from opposite ends of the base in a common direction transverse to the base. The base may have a length between the ends of approximately 0.410 +/−0.0325 inches or 0.410 +/−0.010 inches or 0.410 +/−0.00 inches.

The one or more attachment elements may include one arm supported on one end of the base and a pair of arms supported on the other end of the base for an interleaved configuration when attaching two loops of the strand together. A distance between the one arm and the pair of arms may be approximately 0.290 +/−0.0325 inches, 0.290 +/−0.010 inches or 0.290 +/−0.00 inches to generally match the length of the base.

In still another aspect, the one or more attachment elements may include a plurality of like attachment elements. The attachment elements may further include one or more slits extending from end to end in the base of each attachment element. In one case, the slits may be a pair of slits. A filament may be held in each of the slits. The filament that is held in each of first slits may be a first common filament and may hold the attachment elements together with the first slits of each attachment element aligned with each other. The filament that is held in each of second slits may be a second common filament and may hold the attachment elements together with the second slits of each attachment element aligned with each other. Each of the first and the second common filaments may comprise a nylon material and may be held in respective first and second slits by a compression fit. It is to be appreciated that a single slit and a single filament in the slit may be used in the same way as a plurality of slits and elements.

A material of the attachment element proximate the slits may be work hardened so that the one or more attachment elements may have a strength greater than or equal to a strength of an attachment element without slits. This work hardening effect may be provided by a variety of different processes including, but not limited to, a punching process during formation of the slits, by a crimping step when forming the compression fit, or by both.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
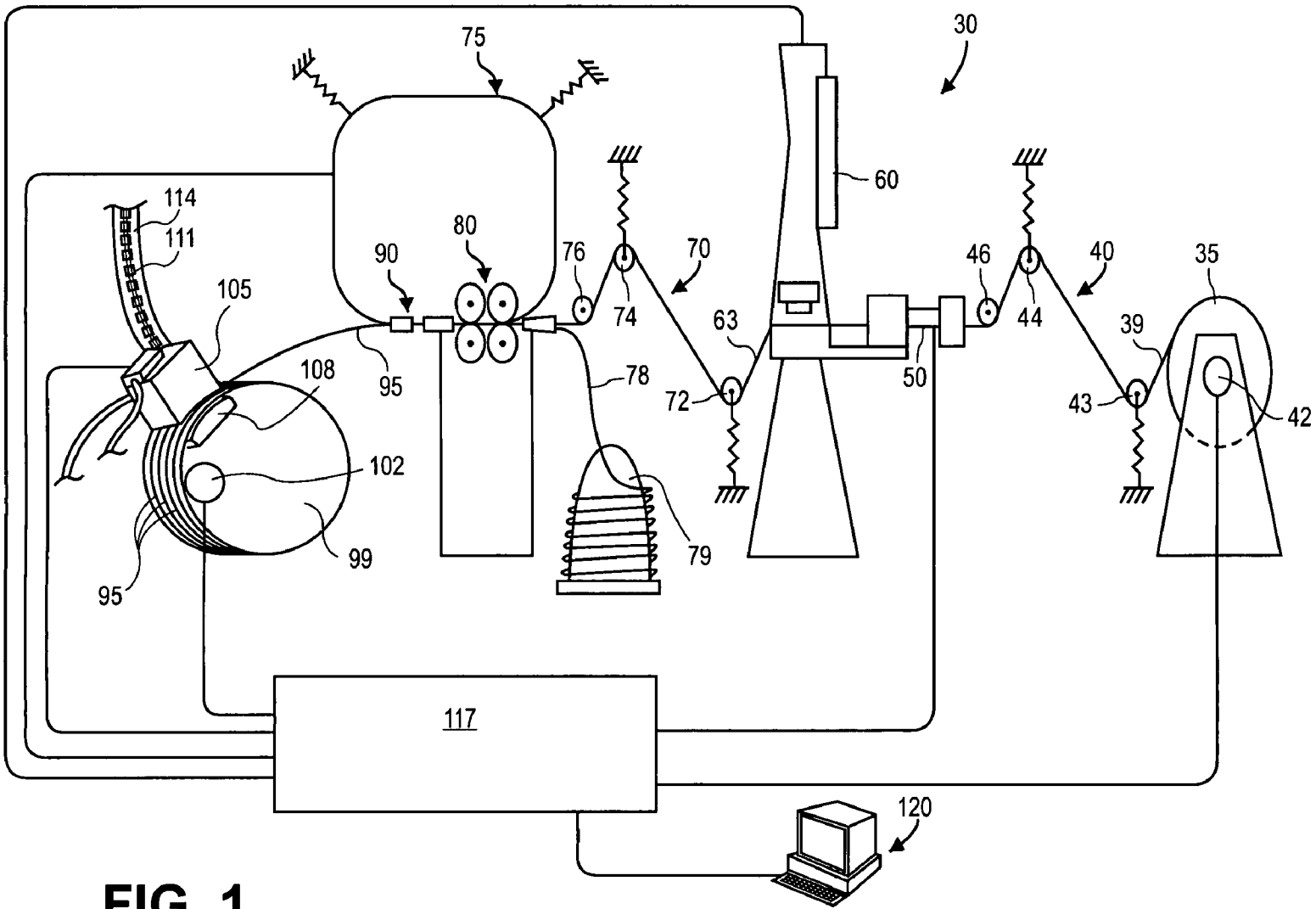
FIG. 1 is a diagrammatic view of a system in accordance with the present invention.

As discussed above, embodiments of the present invention relate to a system and methods of forming a barbed tape product, and are directed more particularly to the product formed by the system and methods. For example, FIG. 1 is a diagrammatic view of a machine or system of machines 30 for forming a barbed tape product in accordance with the present invention. As such, the system includes a spool 35 of tape 39 in the form a thin flat tape stock material. The spool 35 may be automatically turned by a motor 42. The tape 39 is guided through a shock absorbing portion of the system that includes guide rollers 43, 44, and 46. Then a feed device 50 moves the tape 39 into a blanking press 60. The blanking press 60 forms barbs on the tape 39. Thus, a barbed tape 63 is guided by idlers 72, 74, and 76 into a forming station 75 from a reel 79. In the forming station 75, a roll former 80 forms the barbed tape 63 at least partially around the wire 78 to form an integral barbed tape product. The barbed tape product is moved forward through the system into a radial bender 90. The radial bender 90 provides a continuous bend into the barbed tape product so that the barbed tape product is biased into coils. The coils are subsequently wound into rolls corresponding generally to the size of the coils for further processing, storage, shipping, and dispensing. Hence, as the barbed tape product leaves the radial bender 90 and the forming station 75, it does so as a radially bent single strand of barbed tape product 95.

This strand of barbed tape product 95 is received on a take up reel 99. The take up reel 99 may have a motorized product pulling paddle 102 for moving the strand of product 95 circumferentially around the take up reel 99. A clip gun 105 and an anvil 108 are disposed on radially opposite sides of product strands 95 on the take up reel 99. A string of interconnected clips 111 are fed into the clip gun 105 by a clip slip 114. The clip gun 105 is pneumatically, hydraulically, or otherwise powered to automatically and repeatedly clip adjacent strands 95 together in a predetermined pattern as will be described in greater detail below.

Advantageously, an electronic controller 117 is integrated with the system 30. The electronic controller 117 may be preprogrammed via a programming device 120. The programming device 120 may remain connected to the electronic controller or may be removed once the electronic controller 117 has been programmed. As shown in FIG. 1, the electronic controller is operatively connected to the various portions or machines within the system 30 in order to synchronize the operation of the various portions with each other. For example, the electronic controller may be operatively connected with the stock tape reel motor 42, the feed device 50, the blanking press 60, the forming station 75, the motorized paddle 102 of the take up reel 99, and the automatic clipping gun 105. Thus the system 30 can automatically form, coil, and attach adjacent loops of the product strand 95 under the control of the electronic controller 117.

Figure 2A:
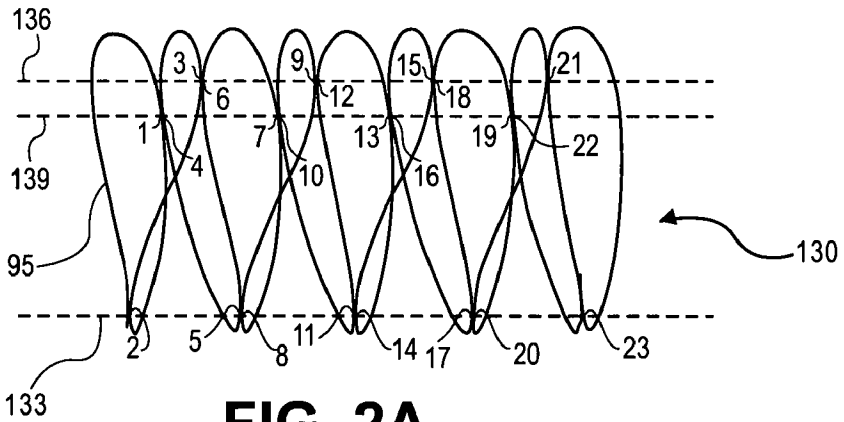
FIG. 2A is a diagrammatic side view of a segment of product having a standard concertina configuration.

FIG. 2A is a diagrammatic side view of a deployed segment 130 of barbed tape product in a standard concertina configuration. As such, attachment points 1 to 23 are formed generally along an odd number (in this case three) of axially extending and circumferentially spaced lines 133, 136, and 139. A first axially extending line 133 is disposed near a base of a deployed segment 130 of the product. A second axially extending line 136 is disposed generally at an upper rear position on the segment 130. A third line 139 is disposed in a generally forward and upward position on the segment i 30. in a standard concertina configuration, the attachment points 1 to 23 are generally equally circumferential spaced from each other, In order to achieve the concertina configuration, the product strand 95 is attached to adjacent strands in the helical coil of the product 130 in a predetermined manner. Specifically, the strand 95 is attached to itself at attachment points on lines 133, 136 and 139 in a helically progressive pattern as will be described below.

The segment 130 of FIG. 2A is a right-handed helix to the right. Thus, the strand 95 progresses in a clockwise direction toward the right as viewed from the left. By numbering points on the strand 95, which form part of the attachment points 1 to 23, in a helically progressive manner, a helically progressive pattern of attachment can be recognized. Thus, starting at the point labeled 1 in FIG. 2A and moving in a clockwise direction to the right the strand 95 reaches a second attachment point labeled 2 with a next rearwardly adjacent loop on line 133. Progressing in a clockwise direction from the point labeled 2 on the strand 95 to the point labeled 3, at which the strand 95 is connected to the next forwardly adjacent loop on line 136, starts a repeating pattern of attachment. The pattern in this case is that the strand 95 is attached to a next rear adjacent loop at a third of the distance around the circumference and then attached to a next forwardly adjacent loop after another third of the distance around the circumference. After the third of travel in a clockwise direction a forth point on the strand 95 labeled 4 forms an attachment point with the next rearwardly adjacent point, which is also labeled 1. This pattern of attachment to alternating forward adjacent and rearward adjacent portions of the strand 95 is repeated throughout the segment 130. The result is a product 130 that can be deployed in a concertina configuration. Since the attachment points lie generally on the equally spaced lines 133, 136 and 139, and the pattern is a consistently repeated pattern, the product 130 will naturally form a straight line configuration when deployed.

While the configuration shown in FIG. 2A may be advantageously manufactured in accordance with the present invention, and the predetermined pattern may be provided automatically under control of the electronic controller, the placement of the attachment points in FIG. 2A may be located differently as described below with regard to FIGS. 2B through 6B below.

Figure 2B:
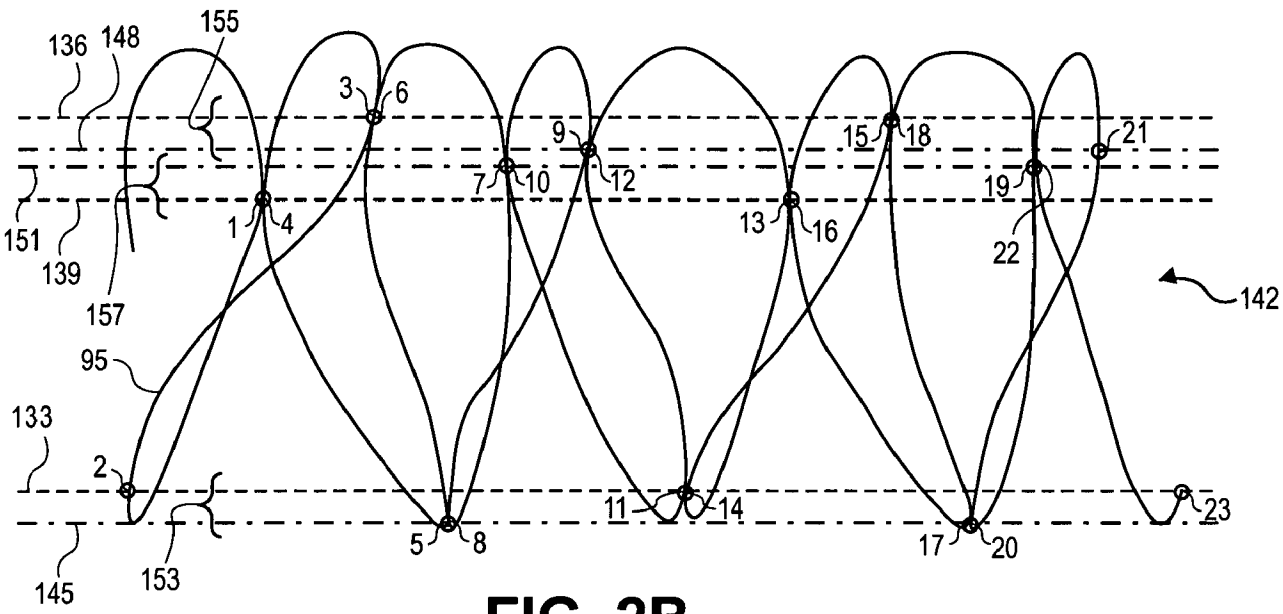
FIG. 2B is a diagrammatic side view of a modified concertina configuration in accordance with the present invention.

As shown in FIG. 2B, lines 133, 136 and 139 correspond to those shown in FIG. 2A labeled with the same numerals 133, 136, and 139. Sets of attachment points disposed generally on these lines 133, 136, and 139 are disposed generally equally spaced about the circumference of the segment. However, FIG. 2B shows a segment 142 having a different configuration of attachment points. In this case, three additional lines are defined as offset lines 145, 148 and 151. The offset lines 145, 148 and 151 are offset from lines 133, 136 and 139 by a predetermined circumferential distance. Lines 133 and 145 form a first pair of lines 153 located generally at a bottom of segment 142. Lines 136 and 148 form a second pair of lines 155 located generally at an upper rear of the segment 142. A third pair of lines 157 provide a third pair of lines 139, 151 located generally at an upper front of the segment 142.

The helical aspect of the segment 142 in F*igure* 2B progresses in a clockwise direction to the right. As described with regard to FIG. 2A above, the attachment pattern progresses by the strand of product 95 being attached first to the next rearwardly adjacent loop and then to the next forwardly adjacent loop and so forth in a helically progressive manner. As shown in FIG. 2B, one full loop is formed by the product strand 95 as it progresses from the point 1 on the strand 95 to the point 4 on the strand. As may be appreciated, all of points 1 through 4 are located on lines 133, 136, and 139, which are not offset. The next coil in the helically progressive pattern is formed by the product strand as it progresses from the point 4 to the point 7 on the strand. However, it is to be noted that point 5 is located on offset line 145. Likewise, point 7 is located on offset line 151, and the second coil is just short of a completely circumferential coil of 360 degrees by the circumferential distance of the offset. A third coil is provided as the strand 95 of product progresses from point 7 to point 10. As may be appreciated, the third coil is very similar in appearance to the first coil. However, each of points 7, 8, 9, and 10 are located generally on the offset lines 145, 148, and 151.

By following the same helically progressive pattern, the fourth coil transitions back to attachment points on the non-offset lines 133, 136 and 139. The result of this progressive pattern is that each subsequent attachment point on a given pair of lines 153, 155, 157 is offset relative to the attachment point immediately previous thereto on that pair. This arrangement has important manufacturing benefits. In particular, offsetting the attachment points in this manner reduces or eliminates mis-clipping by a clipping gun such as that shown in FIG. 1. This is due to the fact that the immediately previous clip on a pair of lines is not circumferentially aligned with the attachment point at which a subsequent clip is to be applied by the clipping gun.

Figure 3:
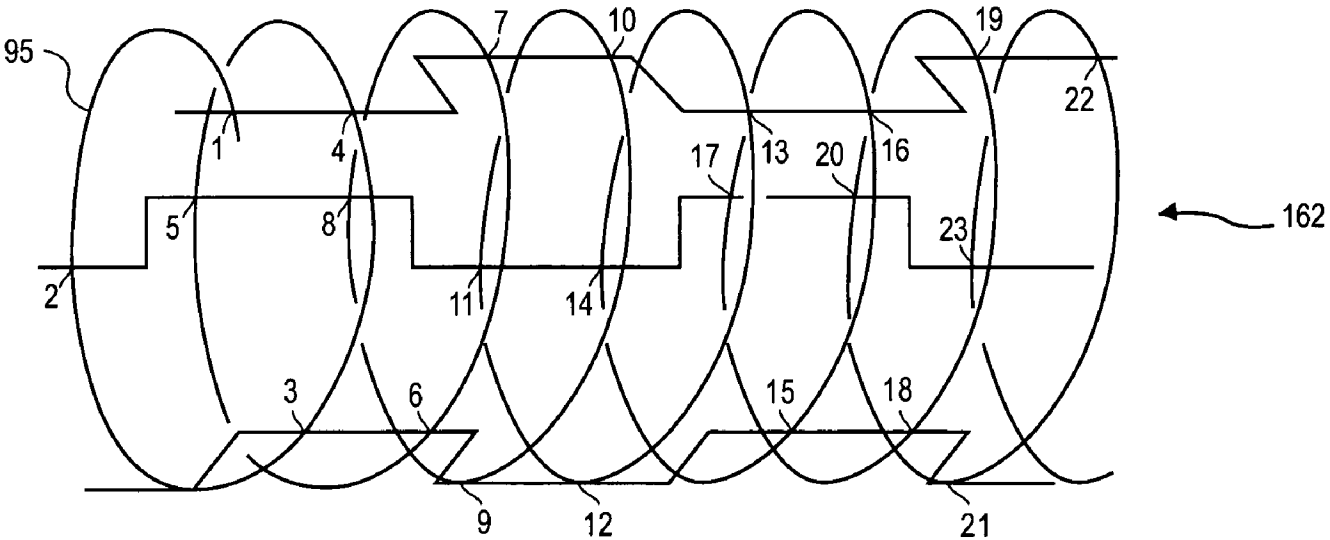
FIG. 3 is a diagrammatic perspective view of a helically coiled barbed tape product depicting attachment points required to achieve the concertina product of FIG. 2B.

With regard to FIGS. 2B and 3, it is to be understood that an attachment point on a first pair of product loops will be circumferentially offset relative to an attachment point of an adjacent second pair of loops that would have otherwise been circumferentially aligned in the standard concertina product. Furthermore, an attachment point of the first pair of loops will also be offset relative to every other attachment point of the adjacent second pair of product loops. This is somewhat challenging to see when the concertina product is stretched and deformed into its deployed configuration as shown in FIG. 2B. However, it is more easily seen in the undeformed helical configuration shown in FIGS. 3 and 4.

Figure 4:
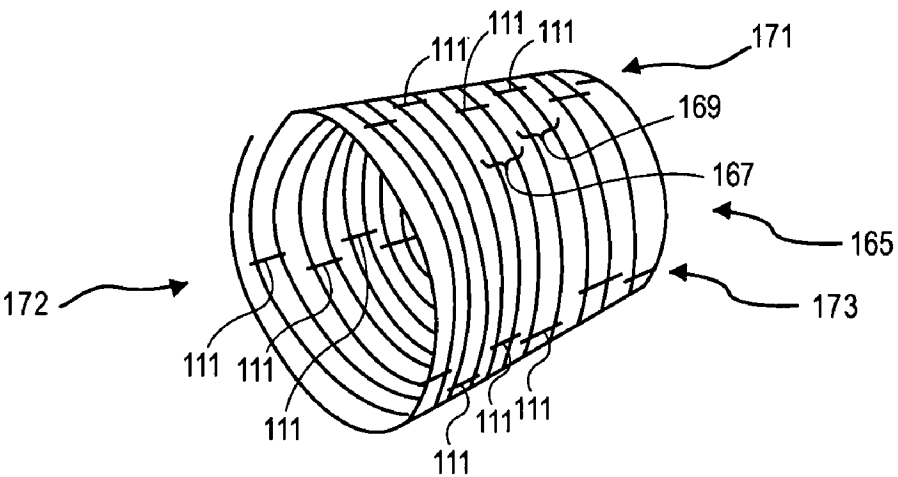
FIG. 4 is a diagrammatic perspective view of the segment of FIG. 3 in a contracted and clipped state.

FIGS. 3 and 4 provide alternative illustrations of how the offset attachment points are distributed on the segment 162, 165 in a non-deformed configuration. Segments 162 and 165 progress in counterclockwise directions to the right. However, the pattern of attachment is substantially similar to that shown and described with regard to FIG. 2B above. For example, attachment point 1 on the product strand 95 is attached to the next forwardly adjacent loop at 4 as indicated by the straight line connecting 1 and 4 in FIG. 3. Next, the strand 95 is connected to a rearwardly adjacent loop at point 2 on the strand. By following the strand helically forward to the right, it can be seen that a point 3 on the strand 95 is attached to the next forwardly adjacent loop at a point 6 on the strand. Then a point 4 on the strand 95 is connected to the next rearwardly adjacent loop at 1. Point 5 is connected to the next forwardly adjacent loop. Point 6 is attached to the next rearwardly adjacent loop. This pattern is implemented in a helically progressive pattern for a complete roll or the segment 162 thereof to provide the pattern of offsets shown by the stepped lines in FIG. 3.

FIG. 4 shows a resultant roll 165 of product in a rolled non-deployed state in accordance with the present invention. As shown, the clips 111 are circumferentially offset relative to each other from one pair of loops 167 to an adjacent pair of loops 169 in a particular circumferential region 171. As may be appreciated, the same is true for clips 111 attached to adjacent pairs of loops in each of the other circumferential regions 172 and 173 shown in FIG. 4. Alternatively described, each pair of loops has one or more attachment points in which first attachment points of a plurality of pairs of loops correspond to each other. In concertina products the number of attachment points for a pair of loops is regularly an odd number and is typically provided in a repeating pattern. In this way, a first attachment point of one pair of loops generally corresponds in position to first attachment points in the other pairs of loops, a second attachment point generally corresponds in position to second attachment points, and a third attachment point generally corresponds to third attachment points. As such, circumferential regions may be defined as regions corresponding in number to the number of attachment points per pair of loops. The circumferential extent of the regions may therefore be 360 degrees divided by the number of attachment points on a pair. The circumferential regions may include areas extending generally equal circumferential distances on each side of respective attachment points. However, when the attachment points of adjacent loops are offset relative to corresponding attachment points in adjacent pairs of loops, then the region may be defined as extending equal circumferential distances from an average circumferential position along a roll of the product.

Figure 5A:
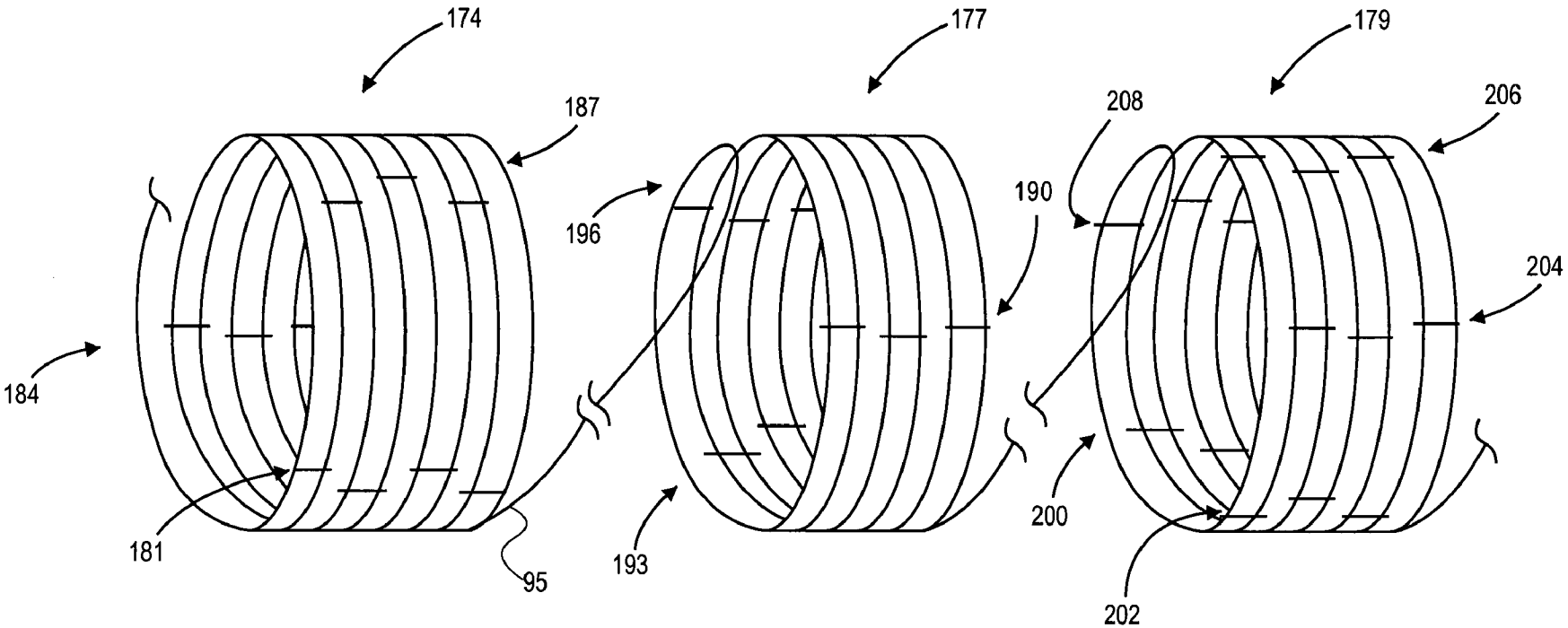
FIG. 5A is a diagrammatic perspective view showing how the pattern of attachment points can be varied from one roll to another.

FIG. 5A shows rolls of product 174, 177, and 179, which may be produced by a system of the present invention. Each of the rolls 174, 177, and 179 have a corresponding set of attachment points. The set of attachment points is programmed into the electronic controller as described previously. These rolls 174, 177, and 179 may be produced in sequence. That is, the electronic controller may be programmed to produce one roll after another with the attachment point pattern varying from one roll to the other. Alternatively, the pattern may be the same for each roll. However, the pattern may be interrupted between rolls. As shown in FIG. 5A, a length of the product strand 95 between the rolls may extend a predetermined distance without clipping by the system. The capability of the system to be preprogrammed in this manner enables continuous production without having to stop the machine for re-threading. As shown, attaching regions 181, 184, 187 may be evenly distributed circumferentially as shown on the roll 174. Regions 190, 193, and 196 may be distributed unevenly about the circumference as shown on roll 177. Any odd number of regions of attachment points may be distributed about the circumference of a roll in order to achieve a concertina configuration. For example, five regions 200, 202, 204, 206, and 208 are shown on roll 179. The number and distribution of these regions shown in FIG. 5A is exemplary only. It is to be understood that any number of regions and any variation of positions for the regions is considered to be within the spirit and scope of the present invention.

Figure 5B:
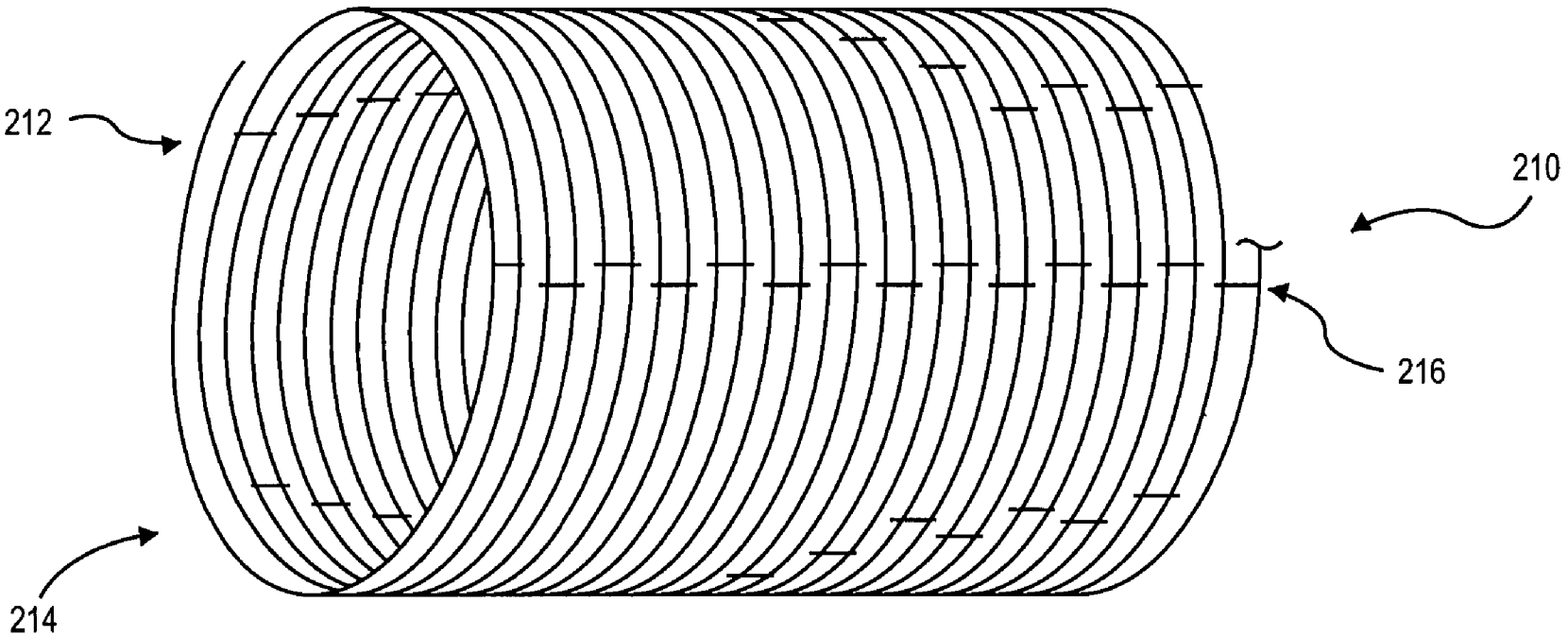
FIG. 5B is a diagrammatic perspective view showing how the pattern of attachment points can be varied within one roll.

Furthermore, as shown in FIG. 5B, the pattern of the attachment points may be varied within a given roll. For example, a roll 210 has a first region 212 and a second region 214 which progress from positions on a rear portion of the roll 210 to positions on a front of the roll in a helically progressive pattern to the right. It is to be understood, that the pattern programmed into the electronic controller and applied to a roll of product such as roll 210 determines the shape in which the product will naturally lie in a deployed state. For example, the right most portion of the roll 210 having attachment points of all 3 regions on the front of the roll 210 will tend to cause the roll to bend out of the page and to the right, as viewed, when the roll is stretched out and placed in its deployed state.

With this in mind, it is to be understood that the electronic controller can be programmed to produce rolls that will provide donut shapes in their deployed states. Alternatively, a roll may be formed that curves first in one direction, then progresses through a straight portion, and then curves in the other direction to form an "S" shape. Thus, the product could be made to form letters or even words in its deployed state. Such precision is made possible by the exactness with which the system of the present invention can be programmed to position attachment points. A more practical application for providing a precisely shaped or configured product may be that of matching the deployed product to a particular contour of a landscape or building structure. For example, product may be customized to extend in a line across the ground, then bend to extend up a wall, and bend again to extend across an edge of a roof.

Figure 6A:
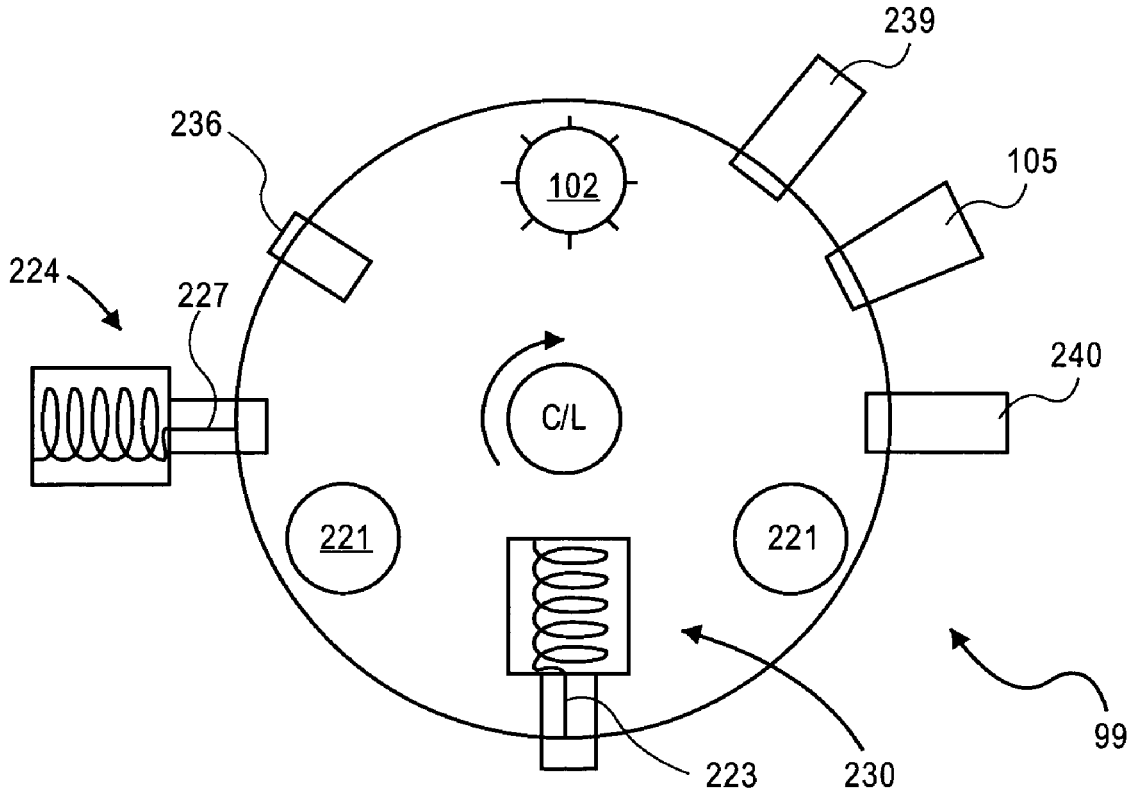
FIG. 6A is a diagrammatic view of the take up reel showing several devices supported thereon.

FIG. 6A is a diagrammatic view of the take up reel 99 with a variety of devices that may be supported thereon for attaching objects to the barbed tape product of the present invention. Element 105 represents the clipping device 105 shown in FIG. 1 and described above. Element 102 represents the motorized paddle 102 or index paddle described above. The take up reel 99 may further have rollers 221 for aiding smooth rotation of the reel 99. A line attaching device 224 may be provided for attaching a line to the product at predetermined positions under software control. The line attaching device may attach a spacer line 227 to limit separation of selected ones of the loops from each other in the deployed state. A plurality of line attaching devices may be supported on the take up reel 99 at predetermined circumferential positions around the coil of the product to form a generally uniform separation of loops of the strand on all sides of the coil when it is deployed. Alternatively, different spacing lengths of the spacer line 227 may be provided at different positions on the coil to provide a predetermined configuration of the coil in its deployed state.

Other devices may be selectively provided on the take up reel including a sensor line attaching device 230 that may be supported at a generally radially inward position on the reel for attaching a sensor or other line 233 generally on an inside of the product strand. The other line 233 or the spacer line 227 may be one of a plurality of such lines that may include, but are not limited to, spacer lines, trip lines, and/or sensor lines. It is to be understood that the sensor lines may be of any type, including but not limited to magnetic or fiber optic lines. All of these lines may incorporate any suitable material including, but not limited to, metals, plastics, or composites formed as wires, tapes, ribbons, cables, or ropes, for example. The reel 99 may also have a tab inserting device 236 supported thereon for attaching tabs or flags to the strand of product at predetermined positions.

As described above with regard to the attachment points and attachment elements 111, the spacer lines, trip lines, sensor lines, and tabs may be attached at any predetermined positions on the product strand. Furthermore, it is to be understood that these positions may be varied within a roll or unit 373, 385 of the product, or may be varied from one roll to another. As shown, a cut off device 239 may be provided separately from the attaching device for cutting the product at a predetermined position. Alternatively, the cut off device may be provided integrally with the attaching device 105. Furthermore, it is to be understood that one or more of the line attaching devices 224, 230 could be provided integrally with the attaching device 105. In fact, any number of the attaching device 105 and the other devices may be integrated together as attachment mechanisms of an overall device or may be provided separately without departing from the spirit and scope of the invention. It is also to be understood that any number of additional devices such as auxiliary device 240 may be provided on the take up reel to treat the strands of product or attach additional objects in any manner desired to provide a variety of functions to the product. For example, motion sensors or microphones could be attached to the product at selected locations.

Figure 6B:
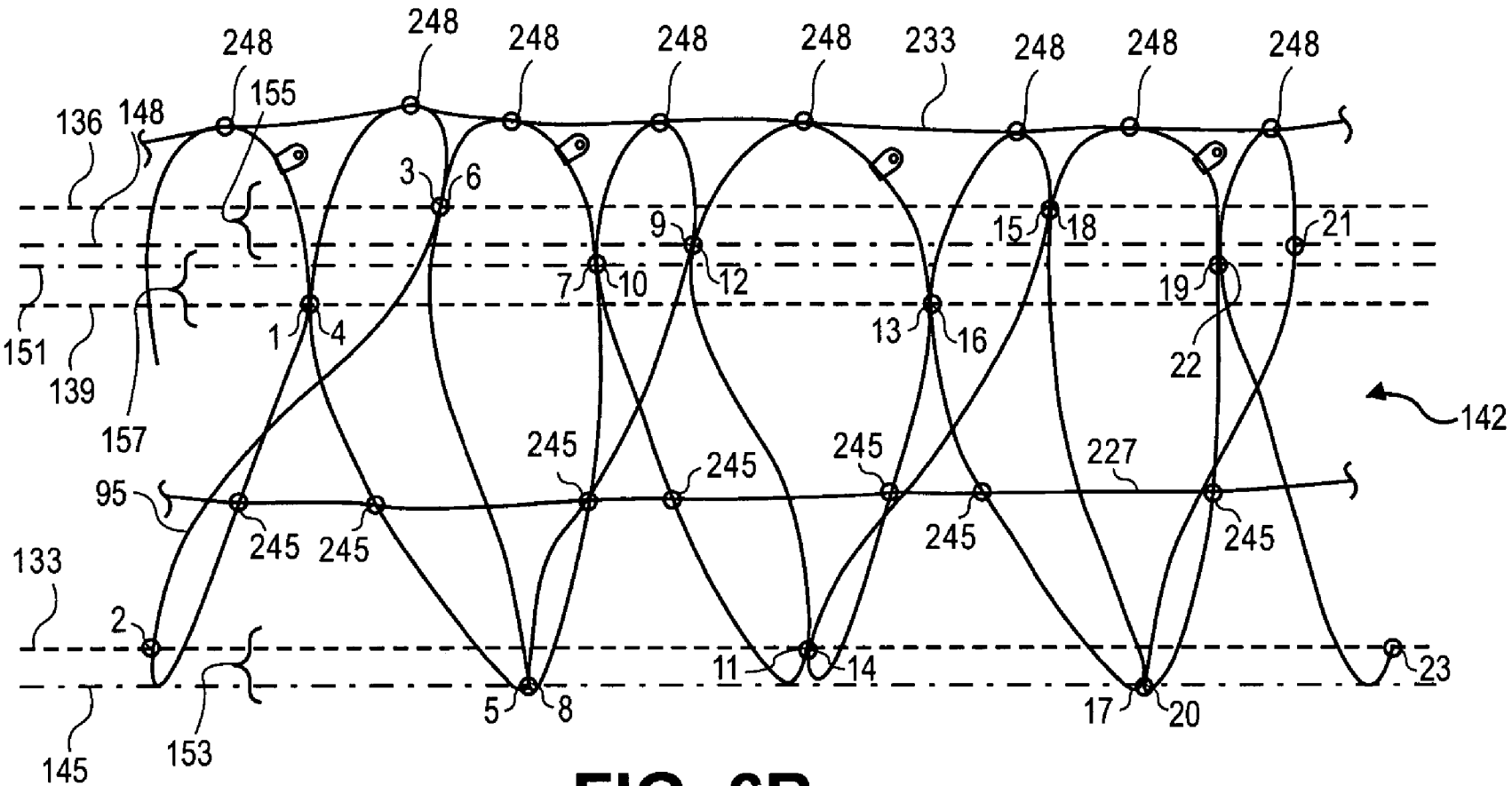
FIG. 6B is a perspective view of a non-concertina barbed tape product having objects attached at various circumferential positions in accordance with the present invention.

FIG. 6B is a perspective view of a segment of barbed tape product 242 having an exemplary spacer line 227 attached to an exterior of the coil by line attachment elements 245. These line attachment elements 245 may be the same as the attachment elements 111 described above and in greater detail below, or they may be attachment elements configured specifically for attaching lines. The attachment elements 111, 245 may function to both attach adjacent loops of the product together and to attach separate objects, including the spacer lines 227. FIG. 6B shows the sensor line 233 held on an interior of the coil by attachment elements 248. As may be appreciated, the spacer lines 227 and the other lines 233 may function as trip lines because they will cause the product to close in upon any intruder that engages the lines 227, 233. While shown in a relatively loose relation similar to hog rings in FIG. 6B, the attachment elements 245, 248 may form a tight crimp on the product 242 in order to hold the lines or other objects to the strand of product at the predetermined positions. Furthermore, the lines 227, 230 may be fastened by other mechanisms including by structural elements integral with the lines 227, 230 themselves, for example. Still further, the line attaching devices 224, 230 may take a form other than that of clipping guns. Axially adjacent attachment elements among each of elements 245 and 248 may be circumferentially offset relative to each other to facilitate automatic attachment under control of the electronic controller. It is to be understood that FIG. 6B is exemplary only. It is expected that two to four spacer lines may also be attached to the product for holding the product in a uniformly distributed position in the deployed state. Also, tabs or flags 251 may be attached to the product at predetermined intervals or selected positions.

The attachment of objects including spacer lines 227, 233 shown and described with regard to FIGS. 6A and 6B may be applied to concertina products as well as to non-concertina products. A method of making a barbed tape concertina product, for example, may include attaching the spacer line at a position of every fifth clip. That is, the electronic controller could be configured to attach the spacer line 227 and then skip four clips and attach the spacer line 227 at the fifth clip. Alternatively, the product may be a non-concertina product and have the same spacing configuration. That is, with attachments at positions where every fifth clip would normally have been in a concertina product. Such an arrangement has great material saving advantages while providing uniform spacing of the loops during deployment.

Furthermore, the non-concertina product formed with spacer lines 227 has the advantage of enabling a method of deploying that is very fast and simple in accordance with the disclosure of U.S. patent application Ser. No. 10/959,530, entitled CONCERTINA TAPE PRODUCTS CONFIGURED FOR STABLE DEPLOYMENT AND RETRIEVAL, by the same inventor, filed Oct. 5, 2004; and U.S.Provisional Patent Application Ser. No. 60/589,668, entitled RAPID DEPLOYMENT BARBED TAPE AND DISPENSER, by the same inventor, filed Jul. 19, 2004, each of which is incorporated herein by reference. This method entails fixing a first end of a roll on the ground or other structure to be protected. Then a truck or other vehicle carrying the rest of the roll may be driven along a path in which the product 242 is to be deployed. A slight tension may be applied to the roll so that the product pays out at the same rate the vehicle moves away from the first end of the product until the roll is completely expanded into its deployed state. Multiple rolls may be connected together and payed out in this manner. The rolls of the non-concertina product formed in the manner described above have a helical configuration, even in the expanded deployed state. Therefore, collection of the product may be advantageously accomplished by an auger that turns and pulls the product into a collection bin. As may be appreciated, such an auger provides great collection advantages since the product is otherwise difficult to handle and especially difficult to collect. Automation of such an auger has additional advantages of increased speed and power in collecting the barbed tape product 242.

Applications for such a barbed tape products are endless. However, in an age when mankind no longer wishes to put up with the horrors of land minds, the capability of configuring barbed tape products in accordance with the present invention may prove to be a highly desirable alternative for selectively protecting large or small areas in a customizable fashion in which the product itself is a deterrent from entry into the area. Unlike land minds, the product of the present invention can advantageously be seen and avoided. On the other hand, the barbed tape products of the present invention can be configured to slow or stop the progress of any person entering an area secured therewith.

Figure 7A:
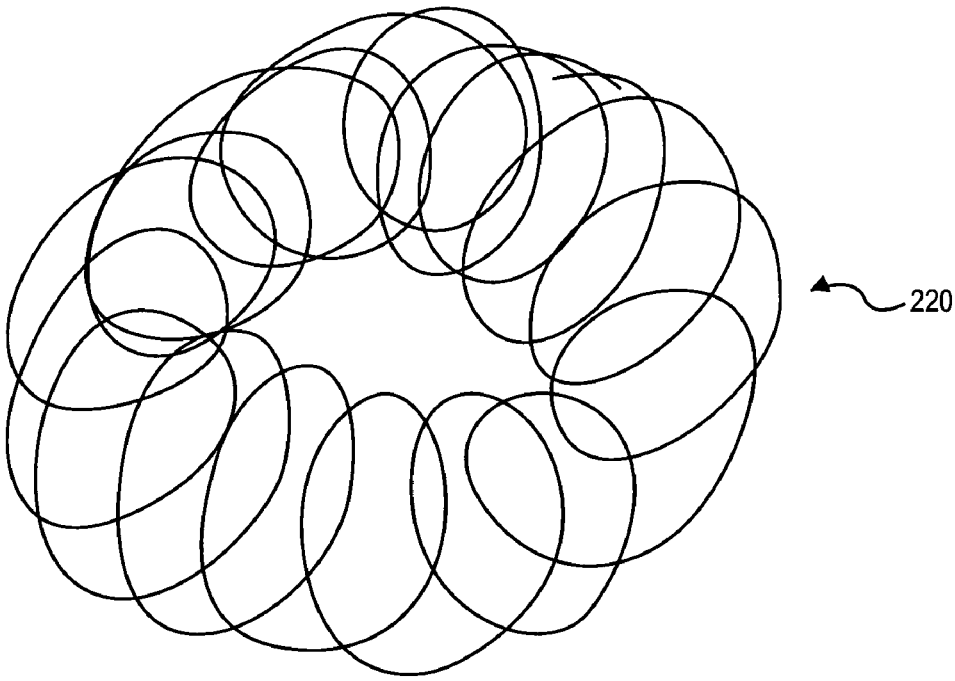
FIG. 7A is a diagrammatic view of a particular segment of product in its natural stretched out or deployed state.

Accordingly, FIG. 7A is a diagrammatic view of a segment of product 220 in its natural stretched out or deployed state. As shown, the natural deployed state of the product segment 220 is in the form of a donut. As may be appreciated, such a configuration may be provided by a pattern of attachment points that are placed on one side of the product coils.

Figure 7B:
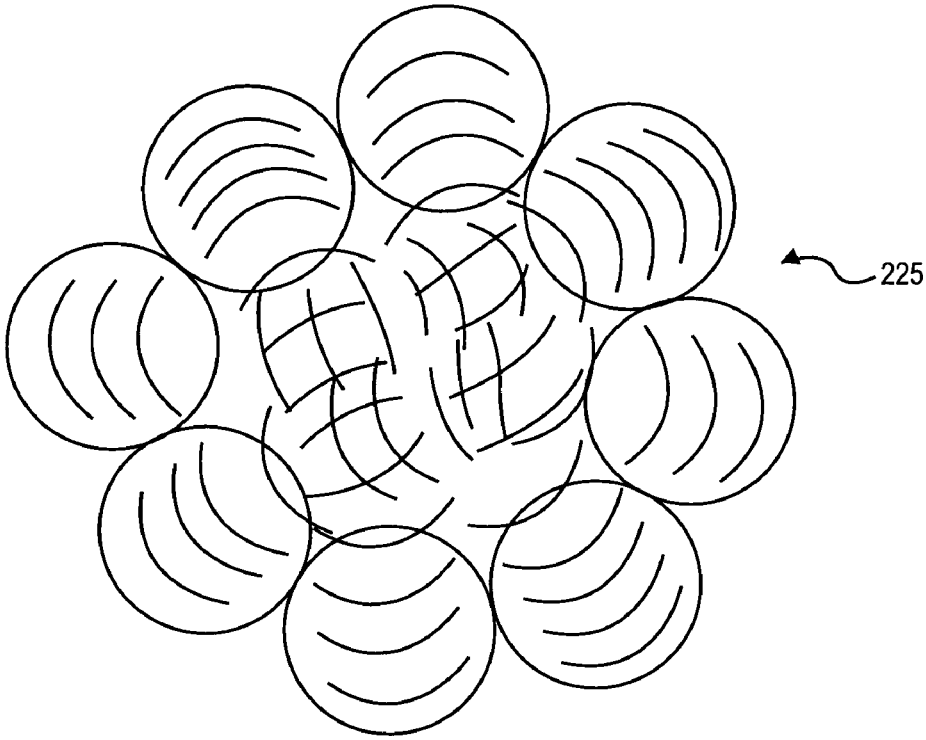
FIG. 7B is a diagrammatic view of a segment of concertina product configured to generally form a ball in a deployed state.

FIG. 7B is a diagrammatic view of a segment 225 of barbed tape product configured to generally form a ball in a deployed state. As may be appreciated, the attachment points required to form a ball may be placed to generally form hoops, but which cause the product to bend out of a plane of each hoop and into a subsequent hoop plane so that the result is the ball configuration shown in FIG. 7B, for example.

Figure 8A:
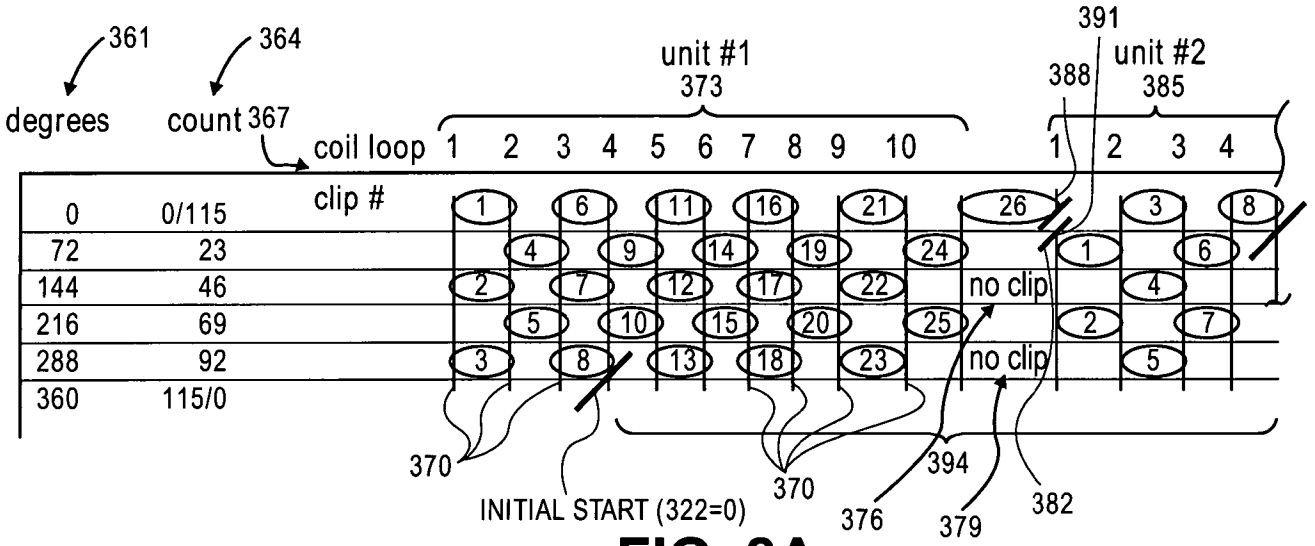
FIGS. 8A and 8B are tables of an exemplary attaching sequence in accordance with a predetermined pattern that may be programmed into an electronic controller in accordance with the present invention.
Figure 8B:
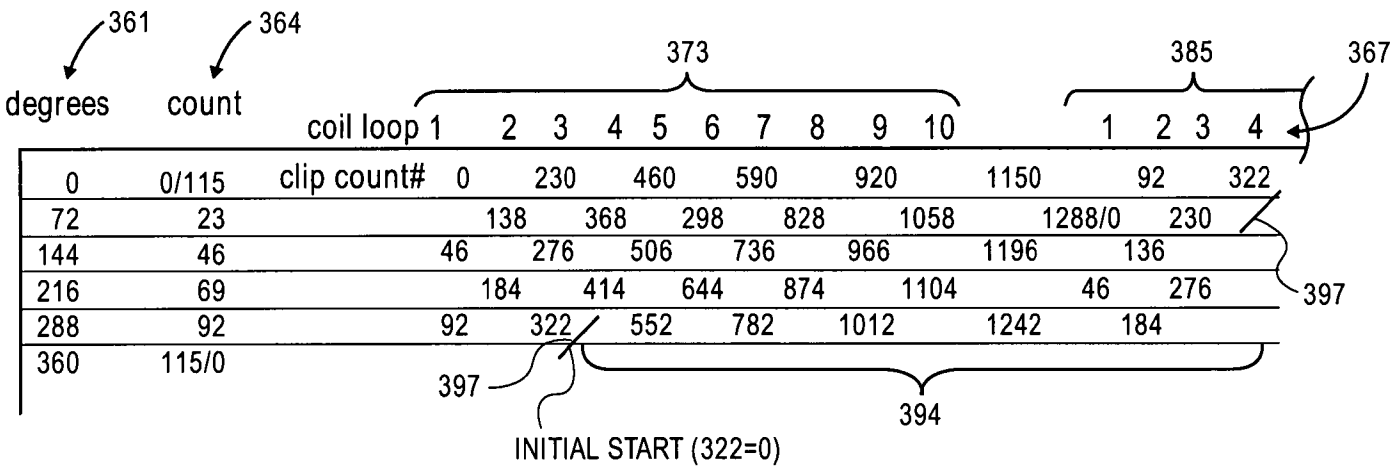

FIGS. 8A and 8B are tables showing an exemplary clipping sequence that may be programmed into the electronic controller in order to produce a barbed tape product of a particular configuration. The specific example shown in FIGS. 8A and 8B is for a ten loop coil with 5 clips per 720 degrees (pair of loops), and 26 clips total. The tables also include indications of steps for suspending clipping for a predetermined number of intervals or counts between coils, for example. An interval or "count" as used herein is defined as the distance between adjacent sets of barbs along the product strand 95. The motorized paddle 102 may register the number of intervals during which clipping is suspended as well as registering the number of intervals between clipping at the predetermined attachment points. Therefore, the motorized paddle may function as a counter and an index paddle to function as will be described below. Alternatively, a separate counter and/or index paddle may be provided.

In the table of FIG. 8A, a first column 361 indicates a position in degrees at which clips are to be attached. A second column 364 indicates a distance at which the clips are attached in terms of intervals or counts along the product strand in each coil. A first row 367 of the table indicates which loop is being clipped by sequential numbers of loops listed from left to right. The numbers in the body of the table of FIG. 8A represent clip numbers in the sequence in which they are attached. The vertical lines 370 represent the loops of a strand of product and the lines encircling each of the clip numbers and intersecting pairs of loops represent attachment of the clips to respective loops of the strand. Thus, as shown in FIG. 8A, clips 1 through 3 attach the first loop to the second loop. It is to be noted that the first clip is attached at a position designated at zero degrees and zero counts. In the particular sequence illustrated in FIGS. 8A and 8B, the sixth clip will also be located at zero degrees. However, when the sixth clip is attached, 115 intervals or counts of the strand will have passed through the clipping device subsequent to attachment of the first clip. As shown, the sequence of clipping proceeds in a helically progressive pattern as described above, with sequential clips being attached every 144 degrees until a coil or unit 373 has been completed.

At the end of the coil or unit 373, the system skips attaching two sequential clips as indicated at 376 and 379. Then the machine is stopped and the strand of product is cut off at a position corresponding to break lines 382. With the machine stopped, the coil or unit 373 is pushed off the take up reel, a counter is reset, and the machine is started again. The steps of cutting off, pushing off, and resetting the counter each require an additional time. Accordingly, a separate "delta t" is programmed or otherwise implemented in the electronic controller to provide time for each of these steps between coils. No stopping is required along the strand at the positions where clipping is skipped so a cumulative "delta t" need not be large. Furthermore, a segment of approximately 8 counts may be provided in which the strand is cut. The segment may be greater or less than 8 counts, but provides a length of product that enables separating of adjacent loops therefrom in order to insert a clipping tool. The segment may be 10 or more counts, or may be as few as 2 to 4 counts. The segment shown in FIG. 8A is 23 counts and aligns the attachment points of the first unit 373 with the attachment points of a second unit 385 for ease of illustration. The segment extends between clip number 26 (the last clip of the first unit 373) and clip number 1 of the second coil or unit 385. The cut will generally be made in a central portion of the segment leaving tails forming free ends 388 and 391 extending from respective clip numbers 26 and 1. Any number of clippings may be skipped and any length of segment for cutting the strand may be provided under electronic control. However, as shown, skipping attachment of at least two clips permits a clean break between the units 373 and 385 by a single cut.

Advantageously, the starting and ending point for a cycle 394, generally corresponding in length to a length of strand for a coil or unit 373, may be selected so as not to correspond to the cut off point. For example, a starting and ending point for the cycle 394 shown in FIGS. 8A and 8B is at clip number 9. In this way several loops of product strand are on the take up reel and threaded in the clipping device when the strand is cut between coils or units 373 and 385. At least a portion of these several loops remains threaded in the clipping device and fed onto the take up reel during and after cutting. Therefore, refeeding and rethreading the strand for each coil or unit is not required. Furthermore, an index of the strand is preserved since the counter or index paddle is continuously engaged. On the other hand, if the starting and ending point is made to correspond to the cut off point, then the strand would have to be rethreaded through the clipping device and refed onto the take up reel and index paddle. Such rethreading and refeeding requires down time for the machine and reduces efficiency. Furthermore, continuous operation is difficult if not impossible. On the contrary, the clipping sequences of the present invention have the capability of preserving the index, permitting the steps of cut off, push off, and resetting the counter while remaining under the control of the electronic controller. It is contemplated that the cut off may be effectuated by the clipping machine. Alternatively, a separate machine could perform the cut off step. Further alternatively, a human operator could manually clip during a time interval provided by the electronic controller.

FIG. 8B is a table similar to the table of FIG. 8A. However, the table of FIG. 8B has the number of counts for a given coil at respective attachment points for units 373 and 385 indicated in the body of the table instead of the clip numbers. Thus, a running count for a coil or unit goes from zero up to 1,288, after which the counter is reset to zero again. On the other hand, the electronic controller is set to a starting point for the cycle 394 when the count reaches 322 as indicated by a slash 397. Thus, the cut off and associated steps may be advantageously implemented at an intermediate point in the cycle 394 as described above.

While the tables of FIGS. 8A and 8B show the clips sequentially attached at evenly spaced increments along the strand, it is to be understood that the attachment points can be varied to advantageously provide the offset of the clips from one pair of loops to another as has been described with respect to FIGS. 2A-7B above. This may be implemented with clipping and cut off sequences similar to those of FIGS. 8A and 8B. For example, instead of clipping after each subsequent 46 counts, the clipping sequence may implement clipping at alternating intervals of 45 and 47 counts to achieve the advantages of offsetting the clips along axial lines of a coil in addition to the advantages of the clipping and cut off sequences shown and described with regard to FIGS. 8A and 8B.

Figure 9A:
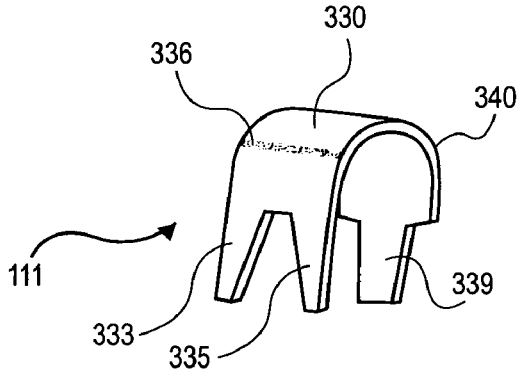
FIG. 9A is a perspective view of an attachment element.

FIG. 9A is a perspective view of the attachment element or clip 111. As shown, the clip 111 has a base 330 and a pair of arms 333, 335 extending from a first end 336 of the base and a single arm 339 extending from a second end 340 of the base 330. The clip 111 has a generally U-shaped configuration. This configuration is similar to a staple structure in which the arms 333, 335, and 339 extend transversely away from the base 330 to form the U-shaped configuration.

Figure 9B:
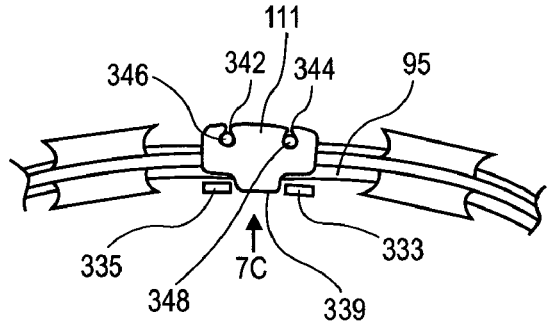
FIG. 9B is a side view of an attachment element clipped onto a pair of product strands.
Figure 9C:
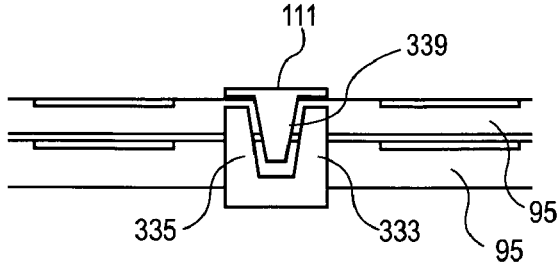
FIG. 9C is a bottom view taken in a direction of arrow 9C of FIG. 9B.

As shown in FIGS. 9B and 9C, the clip 111 may be placed in a generally embracing configuration around a pair of product strands 95. The clip 111 is then crimped onto the product strands 95 into an interleaved configuration as shown in FIG. 9C. That is, the pair of legs 333 and 335 receive the single leg 339 therebetween. Advantageously, the clip 111 may be provided with slits 342 and 344 that receive respective filaments 336 and 348 therein. Additional details with regard to the slits and filaments will be described below.

Figure 9D:
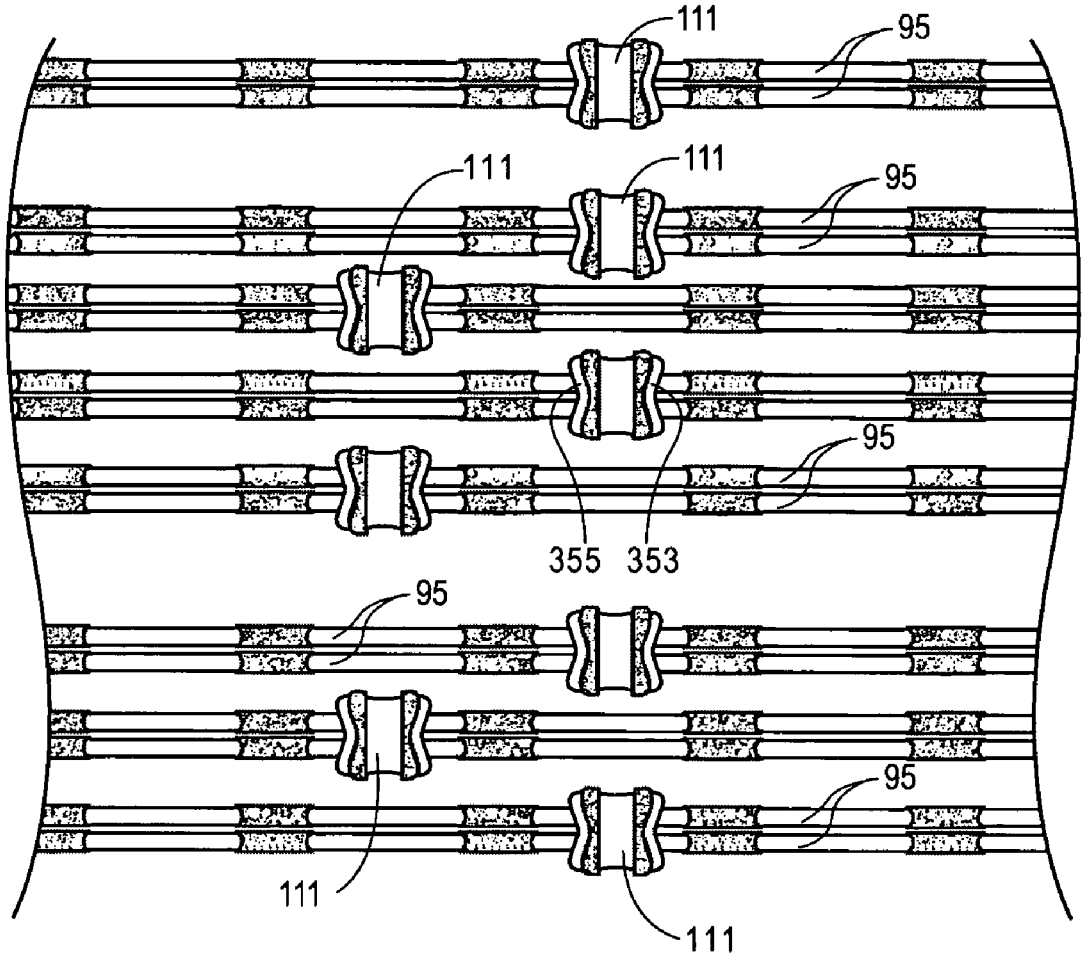
FIG. 9D is a top view of a plurality of attachment elements in a clipped configuration on a respective plurality of pairs of product loops.

FIG. 9D is a top plan view of a plurality of clips 111 attaching strands 95 of adjacent loops together. As may be appreciated, FIG. 9D is a cut away view showing only one region of attachment points of an overall coil of strand 95. As shown, an attachment point defined by an attachment element or clip 111 is offset relative to attachment points on adjacent pair of strands 95. The exception is in the exemplary view of FIG. 9D is the upper two adjacent pairs of strands 95 in which the attachment points are aligned. FIGS. 9B through 9D effectively show how the system of the present invention accurately places the attachment elements 111 and avoids misclipping including placement of the attachment element or clip 111 on a barb, for example. Furthermore, as shown in FIG. 9D, placement of an attachment element or clip 111 in surrounding relation to a pair of strands has the advantage of slightly separating the pair of strands from stands adjacent to the pair. Thus, the target for placement of a subsequently placed clip is enlarged and an open space is provided for arm(s) on one side of the clip 111.

Figure 9E:
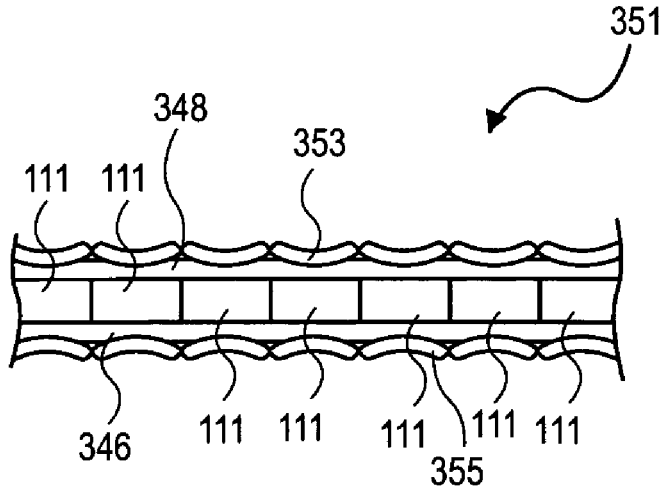
FIG. 9E is a top view of a string of attachment elements held together by common filaments.

FIG. 9E is a top plan view of multiple clips 111 in a string of clips 351. The string of clips 351 is held together by a pair of common filaments 346, 348. These filaments 346 and 348 are disposed in slits 342 and 344 respectively, and are common to all of the clips 111. The filaments 346 and 348 are held in the slits 342 and 344 by a compression fit. As shown in FIGS. 9D and 9E, this compression fit may be achieved by a crimping action that crimps outer side portions 353 and 355 inwardly to engage and compressively hold the filaments 346, 348 in the slits 342, 344. The filaments 346, 348 may be formed or comprised of a tough nylon material, for example. Thus, the clips 111 are held together by the filaments until they are separated during the manufacturing process.

It is to be noted that the inwardly crimping deformation of the outer sides 353 and 355 of the base 330 may provide a work hardening effect that strengthens these portions and the base 330 overall against subsequent bending. Furthermore, it is to be understood that a punching or stamping process for forming the slits 342 and 344 in the base 330 may also act to strengthen the material of the clips 111 surrounding the slits 342 and 344, by work hardening for example. Thus, the bases 330 of the clips 111 may be strengthened in longitudinally extending regions surrounding each of the slits 342 and 344. These strengthening effects were somewhat contraindicated since removal of material would typically be associated with a weakening of the region from which the material is removed.

Figure 9F:
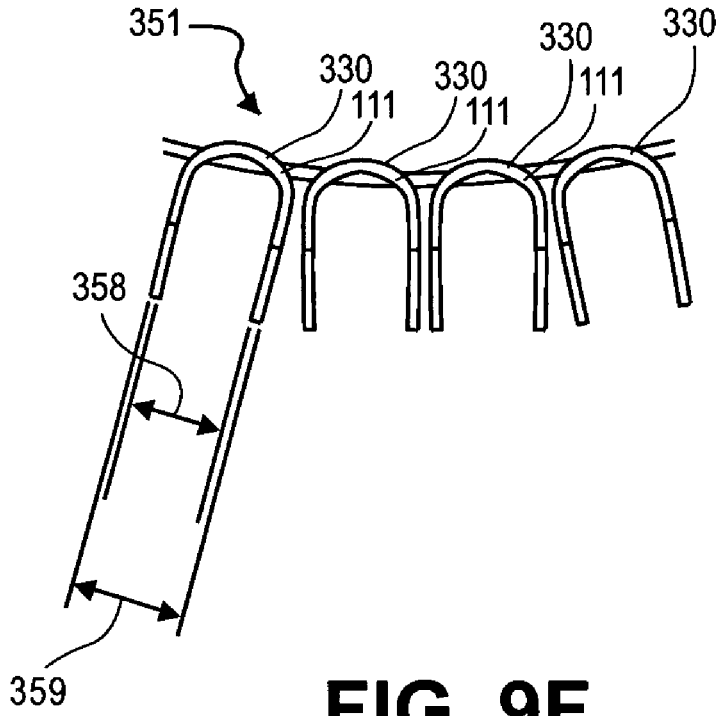
FIG. 9F is a side view of a string of attachment elements connected together by a pair of common filaments.

FIG. 9F is a side view of the string of clips 351. As shown in FIG. 9F, the arms on opposite ends of the base 330 extend generally parallel to each other away from the base 330. The length dimension of the base 330 thus corresponds to a maximum distance at which outer surfaces of the arms at opposite ends of the clips 111 are spaced. This dimension 359 may be 0.410 +/−0.0325 inches, 0.410 +/−0.010 inches, or 0.410 +/−0.00 inches. A spacing dimension 358 corresponds to a spacing between inner surfaces of the arms. This dimension 358 may be 0.290 +/−0.0325 inches, 0.290 +/−0.010 inches, or 0.290 +/−0.00 inches. These dimensions are larger than those of clips available on the market at the time of this invention. In addition to the advantageous work hardening effect provided in the bases 330, it is to be understood that the bases have a generally rounded peak as opposed to a more flattened configuration in the clips of the past.

While the invention has been set forth above in terms of the exemplary embodiments shown in the Figures, it is to be understood that many variations are possible without departing from the spirit and scope of the present invention. For example, it is to be understood that the slits 342 and 344 could be placed in the bases 330 at an orientation rotated by 90 degrees. Thus, the lengths of the slits 342 and 344 would extend in side to side directions as opposed to length directions with respect to the bases 330. The materials utilized for the product and the attachment elements may be varied without departing from the spirit and scope of the invention. For example, the material for filaments 346 and 348 may be selectively varied. Configurations of the attachment elements may be changed without departing from the spirit and scope of the invention. It is to be understood that any attachment element could be used in place of clips 111 shown and described above. Furthermore, the concepts of the present invention could be applied in other applications. For example, a predetermined pattern of attachment points could be applied in making bed springs.

Thus, it can be seen that the present product could be provided in alternative forms. For example, a barbed tape product may be formed of a tape without the reinforcing wire shown and described with regard to FIG. 1. In such cases, providing attachment points in accordance with the details above can still be advantageously implemented.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A barbed tape concertina product comprising:

a strand of the product in the form of a continuous helical coil including at least a first pair of loops and a second pair of loops, said first and second pair of loops arranged in a continuous manner along a longitudinal axis of said helical coil;

a first attachment element at a first attachment point of the first pair of loops and holding the first pair of loops together;

a second attachment clement at a first attachment point of the second pair of loops and holding the second pair of loops together; and a plurality of additional attachment elements at respective additional attachment points in helically progressive position on the strand between the first and second attachment elements, the plurality of additional attachment elements;

wherein the first attachment element is circumferentially offset relative to the second attachment element and wherein the first and second pairs of loops are adjacent pairs of loops.

2. The product of claim 1, wherein the continuous coil further comprises:

additional pairs of loops and additional attachment elements holding the loops of each pair together and holding the pairs of loops together;

the attachment elements generally positioned on one pair of loops so that each attachment element is circumferentially offset relative to all other attachment elements on an adjacent pair of loops.

3. The product of claim 2, wherein the attachment elements are positioned in a predetermined pattern on the continuous coil.

4. The product of claim 3, wherein the pattern is a repeating pattern.

5. The product of claim 3, wherein the pattern provides a predetermined natural configuration of the product when the product is stretched out in a deployed state of use.

6. A barbed tape product, comprising:

a strand of the product in the form of a continuous helical coil:

a first attachment configuration comprising a plurality of first attachment points wherein at least one first attachment point is on the strand;

a second attachment configuration comprising a plurality of second attachment points wherein at least one second attachment point is on the strand;

a plurality of first attachments at the plurality of first attachment points; and a plurality of second attachments at the plurality of second attachment points; the plurality of first and second attachments connecting respective adjacent loops to form pairs of loops;

wherein the first and second configurations correspond to respective first and second lengths of the strand that each extend through an are of at least about 360 degrees and wherein each of the plurality of first attachment points are circumferentially offset relative to each of the plurality of second attachment points.

7. The barbed tape product of claim 6, further comprising:

a first attachment at the at least one first attachment point;

a second attachment at the at least one second attachment point;

wherein the first and second attachments attach the first length to the second length of the strand and the first and second lengths form adjacent first and second loops of the strand corresponding to respective first and second adjacent cycles.

8. The barbed tape product of claim 6, wherein the plurality of first attachments and the plurality of second attachments attach first and second pairs of loops comprising adjacent lengths of the strand together, wherein the first and second pairs of loops correspond to respective first and second adjacent cycles in a helically progressive pattern forming a barbed tape concertina product.

9. The barbed tape product of claim 6, wherein the plurality of first attachments and the plurality of second attachments attach first and second adjacent lengths comprising adjacent first and second loops of the strand together, wherein the first and second lengths correspond to respective first and second adjacent cycles in a helically progressive pattern forming a barbed tape product.

* * * * *